US011118386B2

(12) United States Patent
Rupp et al.

(10) Patent No.: US 11,118,386 B2
(45) Date of Patent: Sep. 14, 2021

(54) GUIDE CARRIAGE FOR THE DISPLACEABLE MOUNTING OF A FURNITURE PART

(71) Applicant: Julius Blum GmbH, Hoechst (AT)

(72) Inventors: Matthias Rupp, Hohenweiler (AT); Ingo Gasser, Hoechst (AT); Franz Kohlweiss, Hard (AT)

(73) Assignee: JULIUS BLUM GMBH, Hoechst (AT)

( * ) Notice: Subject to any disclaimer, the term of this patent is extended or adjusted under 35 U.S.C. 154(b) by 128 days.

(21) Appl. No.: 16/582,617

(22) Filed: Sep. 25, 2019

(65) Prior Publication Data

US 2020/0018106 A1 Jan. 16, 2020

Related U.S. Application Data

(63) Continuation of application No. PCT/AT2018/000043, filed on May 4, 2018.

(30) Foreign Application Priority Data

May 11, 2017 (AT) ..... A 50392/2017

(51) Int. Cl.
*E05B 3/04* (2006.01)
*E05D 15/26* (2006.01)

(52) U.S. Cl.
CPC ..... *E05D 15/266* (2013.01); *E05Y 2900/20* (2013.01)

(58) Field of Classification Search
CPC ..... E05D 15/266; E05Y 2900/20; E05Y 2900/132; E05Y 2900/212; E06B 3/481; E05F 15/605; Y10T 16/364; Y10T 16/3834; Y10T 16/35
See application file for complete search history.

(56) References Cited

U.S. PATENT DOCUMENTS 1,365,594 A * 1/1921 Kules ..... E05D 15/12 16/104
1,384,325 A * 7/1921 Kules ..... E05D 15/12 16/105
2,710,422 A 6/1955 Nelson
(Continued)

FOREIGN PATENT DOCUMENTS

CN 101876229 11/2010
DE 39 03 700 8/1990
(Continued)

OTHER PUBLICATIONS

International Search Report dated Aug. 6, 2018 in International (PCT) Application No. PCT/AT2018/000043.
(Continued)

*Primary Examiner* — Victor D Batson
*Assistant Examiner* — Matthew J Sullivan
(74) *Attorney, Agent, or Firm* — Wenderoth, Lind & Ponack, L.L.P.

(57) ABSTRACT

A guide carriage for displaceably supporting a furniture part on a guide rail, includes a chassis having at least one pivotally mounted running wheel and at least one connecting portion for connecting the guide carriage to the furniture part. At least one positioning device is provided for positioning the connecting portion relative to the chassis in at least one linear direction.

21 Claims, 7 Drawing Sheets

(56) References Cited

U.S. PATENT DOCUMENTS

| | | | | |
|---|---|---|---|---|
| 4,478,006 | A * | 10/1984 | Johnson, Jr. | E05D 15/0626 16/105 |
| 5,085,262 | A | 2/1992 | Tutikawa | |
| 6,698,138 | B1 * | 3/2004 | Lin | E05D 15/0639 16/105 |
| 8,336,972 | B2 | 12/2012 | Haab et al. | |
| 8,381,354 | B2 * | 2/2013 | Haab | E05D 15/0656 16/91 |
| 8,418,318 | B2 * | 4/2013 | Scharf | A47H 15/02 16/106 |
| 8,522,398 | B2 * | 9/2013 | Haab | E06B 3/5045 16/105 |
| 9,085,924 | B2 * | 7/2015 | Tidwell | E05D 15/0669 |
| 9,284,761 | B2 * | 3/2016 | Haab | E05D 15/58 |
| 9,458,654 | B2 * | 10/2016 | Palsson | E05D 15/0634 |
| 9,624,705 | B2 | 4/2017 | Haab et al. | |
| 10,145,166 | B2 * | 12/2018 | Berger | A47B 61/00 |
| 2004/0149523 | A1 * | 8/2004 | Bass | E05D 15/0634 187/334 |
| 2010/0269291 | A1 * | 10/2010 | Haab | E06B 3/5045 16/91 |
| 2010/0270898 | A1 * | 10/2010 | Haab | E05D 15/58 312/323 |
| 2014/0150208 | A1 | 6/2014 | Haab et al. | |
| 2016/0201368 | A1 | 6/2016 | Haab et al. | |
| 2016/0312520 | A1 | 10/2016 | Berger et al. | |
| 2020/0018107 | A1 * | 1/2020 | Rupp | E05F 3/14 |

FOREIGN PATENT DOCUMENTS

| | | |
|---|---|---|
| DE | 10 2010 038 140 | 4/2012 |
| DE | 20 2011 050 006 | 9/2012 |
| EP | 2 246 509 | 11/2010 |
| EP | 2 740 870 | 6/2014 |
| JP | 1-139783 | 9/1989 |
| JP | 2010-261301 | 11/2010 |
| TW | I494494 | 8/2015 |
| TW | I494496 | 8/2015 |

OTHER PUBLICATIONS

English translation of Search Report dated Aug. 22, 2018 in Taiwanese Application No. 107101174.

Office Action dated Nov. 18, 2020 in corresponding Japanese Patent Application No. 2019-559810, with English Translation.

English translation of Search Report issued with Office Action dated Oct. 16, 2020 in Chinese Application No. 201880029852.X.

* cited by examiner

GUIDE CARRIAGE FOR THE DISPLACEABLE MOUNTING OF A FURNITURE PART

BACKGROUND OF THE INVENTION

The present invention relates to a guide carriage for the displaceable support of a furniture part on a guide rail, in which the guide carriage includes a chassis having at least one pivotally mounted running wheel and at least one connecting portion for connecting the guide carriage to the furniture part.

The invention further concerns an arrangement comprising at least one guide rail and at least one guide carriage of the type to be described.

Furthermore, the invention relates to a method for mounting a guide carriage to a guide rail.

Such guide carriages are utilized for the displaceable support of a furniture part, for example of a door wing, relative to a guide rail. The guide carriage, in the mounting position, is on the one hand connected to the furniture part via a connecting portion, and, on the other hand, is movably supported along the guide rail via the chassis. Due to a possible warpage of the furniture part and/or due to an effected adjustment of the furniture part in relation to a furniture carcass, these changes in position of the furniture part are also transmitted to the guide carriage. This may eventually lead to that the door wing is misaligned and/or that the door wing is not arranged in a common closing plane in relation to a further furniture part.

SUMMARY OF THE INVENTION

It is an object of the present invention to propose a guide carriage of the type mentioned in the introductory part, thereby avoiding the drawbacks as discussed above.

According to the invention, at least one positioning device is provided for positioning the connecting portion relative to the chassis in at least one linear direction.

By the positioning device, the connecting portion configured to be connected to the furniture part can be positioned, in the mounting condition, in a height direction and/or in a lateral direction and/or in a depth direction relative to the chassis.

The positioning device can include at least one movably-mounted actuating element, and by an actuation of the actuating element, a position of the connecting portion relative to the chassis can be actively adjusted. Alternatively or in addition, the positioning device can be configured as a compensating device by which a position of the connecting portion relative to the chassis can be passively compensated, for example by a self-locking connection between the connecting portion and the chassis. The connecting portion can be adjusted relative to the chassis by applying a force against the self-locking connection. For example, this can be effected by a frictional connection, so that the connecting portion is configured to be adjusted relative to the chassis after overcoming the frictional force. Accordingly, the connecting portion can be adjusted relative to the chassis by applying a force to the mounted furniture part (for example by applying a pressure force to the furniture part in a direction of the closed position), and, after overcoming the frictional force, possible warpings and/or malpositions of the furniture part can be corrected.

According to an embodiment, the connecting portion is configured to be releasably connected to the chassis by a fastening device, preferably by engaging the connecting portion to the chassis. The at least one positioning device is configured so as to be separate from the fastening device and is arranged on the connecting portion. This offers namely the comfortable possibility that:

- the chassis, in a first mounting step, can be mounted to the guide rail, independently and separately from the connecting portion,
- the connecting portion, in second mounting step, can be mounted to the furniture part, independently and separately from the chassis,
- the furniture part, in a third mounting step, is connected by means of the fastening device to the chassis mounted to the guide rail, via the connecting portion mounted to the furniture part, and that
- in a further step and in a connected condition between the connecting portion and the chassis, a position of the connecting portion relative to the chassis can be adjusted by the at least one positioning device.

According to a further embodiment, a first positioning device and at least one second positioning device are provided, and the connecting portion can be adjusted in a height direction relative to the chassis by the first positioning device and can be adjusted in a lateral direction relative to the chassis by the second positioning device, and the first positioning device and the at least one second positioning device are arranged on the connecting portion. Due to the arrangement of the positioning devices on the connecting portion, an improved accessibility to the positioning devices can be enabled in a connected condition between the connecting portion and the chassis, so that the positioning devices can be actuated by a person in a position being remote in relation to the guide rail, for example in a lower position.

According to an embodiment, the chassis can have a, preferably U-shaped, carrier, and the connecting portion is connected or is configured to be releasably connected to the carrier by at least one fastening device. Thereby, the connecting portion is configured so as to be pre-mounted to the furniture part, and the pre-mounted connecting portion can be connected to the carrier by engaging, by inserting or by pushing onto the carrier. With a constructive simple solution, it can be provided that the fastening device includes at least one bearing location arranged on the carrier, and the bearing location engages in a corresponding recess of the connecting portion in a mounting position of the connecting portion. In a mechanical reversal, it is, of course, also possible that the bearing location is formed or arranged on the connecting portion and the corresponding recess is formed or arranged on the carrier.

The arrangement according to the invention comprises at least one guide rail and at least one guide carriage of the type in question.

BRIEF DESCRIPTION OF THE DRAWINGS

Further details and advantages of the invention result from the following description of figures, in which.

DETAILED DESCRIPTION OF THE INVENTION

Figure 1A:
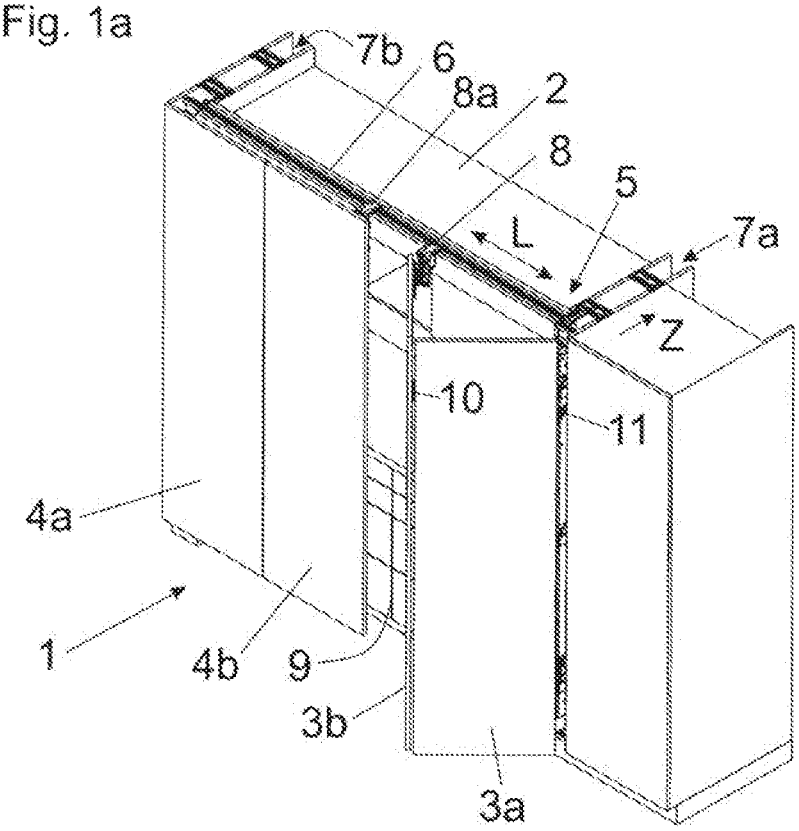
FIG. 1*a*, 1*b* are two perspective views of an item of furniture with furniture parts which are movably supported relative to a furniture carcass by a guide system.

FIG. 1*a* shows a perspective view of an item of furniture 1 with furniture parts 3*a*, 3*b* and 4*a*, 4*b* which are movably supported relative to a furniture carcass 2 by a guide system 5. The guide system 5 includes a first guide rail 6 having a longitudinal direction (L), and a second guide rail 11 extending transversely, preferably at a right angle, to the longitudinal direction (L) for guiding the furniture parts 3*a*, 3*b* in a direction (Z). A guide carriage 8 connected to the furniture part 3*b* is configured to be moved along the first guide rail 6 and relative to the second guide rail 11. For example, the first guide rail 6 can bear against an upper side of the furniture carcass 2, and the first guide rail 6 and the second guide rail 11 are spaced from each other in a height direction or can also be arranged on a same height position. The furniture parts 3*a*, 3*b* can be inserted into a lateral cavity 7*a* when being arranged in a parallel position to one another. By a second guide carriage 8*a* connected to the furniture part 4*b*, the two other furniture parts 4*a*, 4*b* can be moved relative to the first guide rail 6 and can be inserted into a lateral cavity 7*b* when being arranged in a parallel position to one another. Each of the furniture parts 3*a*, 3*b* and 4*a*, 4*b* are pivotally connected to one another by furniture hinges 10, so that each of the furniture parts 3*a*, 3*b* and 4*a*, 4*b* are hingedly connected to one another about a vertically extending axis.

Figure 1B:
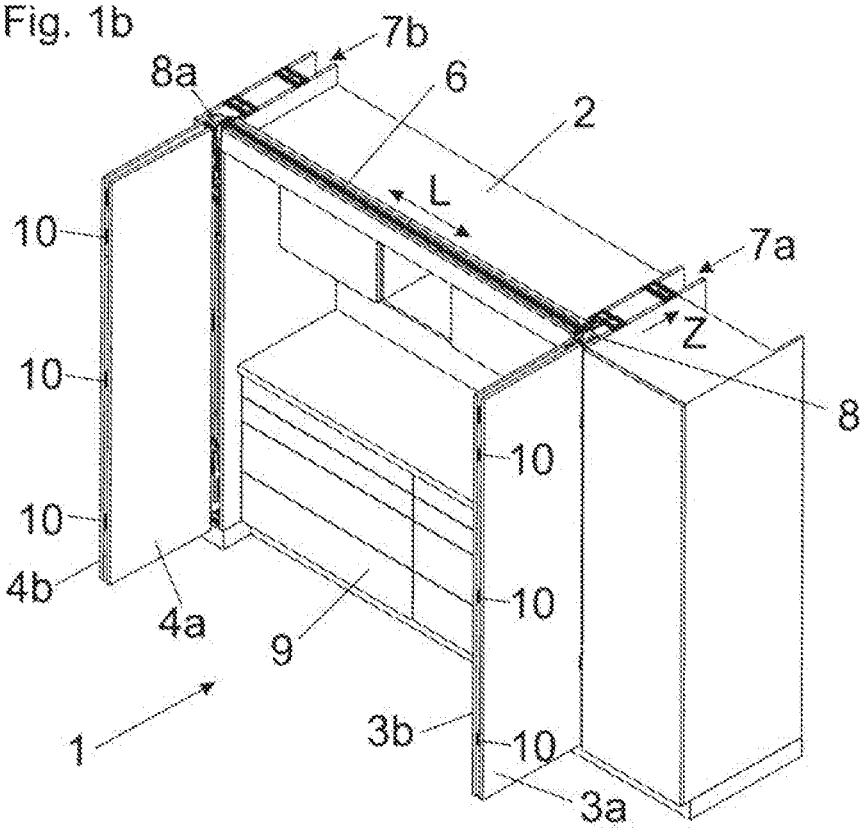

FIG. 1*b* shows the item of furniture 1, in which each of the furniture parts 3*a*, 3*b* and 4*a*, 4*b* are aligned parallel to one another and can be inserted into the lateral cavities 7*a*, 7*b* in a direction (Z) extending transversely to the longitudinal direction (L). The first furniture part 3*a* and the second furniture part 3*b* are connected by a plurality of furniture hinges 10 spaced from each other. The furniture parts 3*a*, 3*b* are movable from a parallel position, in which the furniture parts 3*a*, 3*b* can be inserted into the lateral cavity 7*a*, and a second position, in which the furniture parts 3*a*, 3*b* adopt a coplanar position to one another and thereby cover an inner cabinet 9.

Figure 2A:
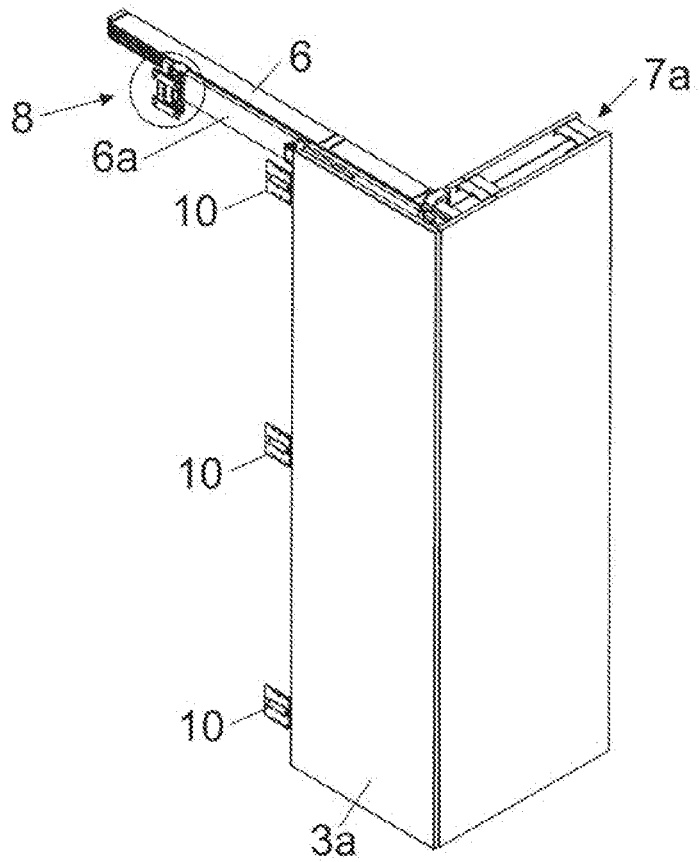
FIG. 2*a*, 2*b* are a partial section view of the item of furniture and an enlarged detail view of the guide carriage configured to run along the guide rail.

FIG. 2*a* shows a partial section of the item of furniture 1, in which the second furniture part 3*b* is hidden for the sake of improved overview. The guide rail 6 can be arranged on an upper side of the item of furniture 1, and the guide carriage 8 configured to be connected to the furniture part 3*b* can be displaced along the guide rail 6.

Figure 2B:
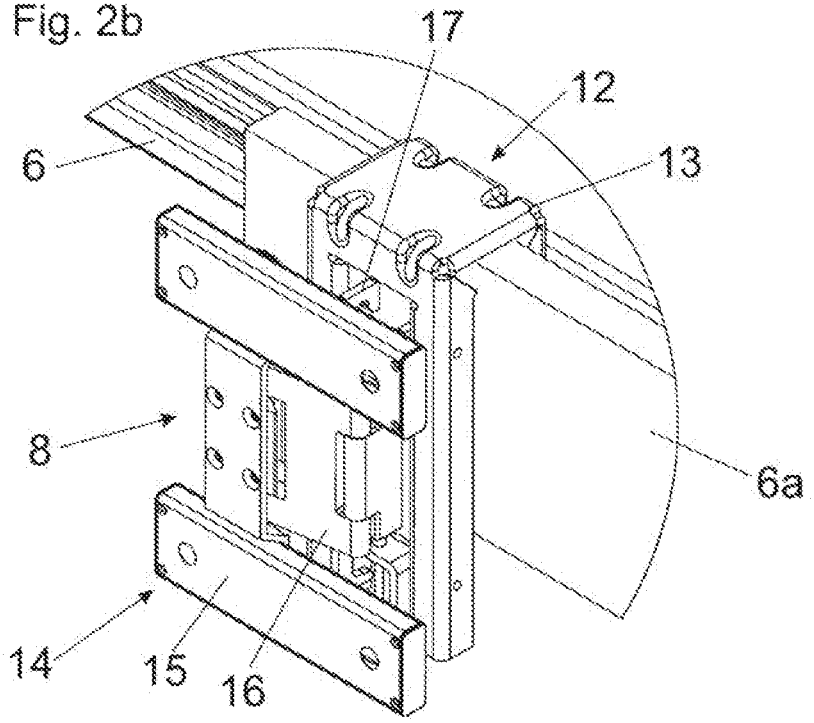

FIG. 2*b* shows the region encircled in FIG. 2*a* in an enlarged view, in which the construction of the guide carriage 8 emerges in greater detail. The guide carriage 8 includes a chassis 12 which is connected or which is configured to be connected to a, preferably U-shaped, carrier 13. The chassis 12 includes at least one rotatable running wheel 18 (not shown here) configured to run along the guide rail 6. The U-shaped carrier 13 is configured to be slid in a lateral direction onto a vertically extending limb 6*a* of the guide rail 6, and the limb 6*a* is accommodated within the U-shaped section of the carrier 13 in the mounted position. A bearing portion 17 is connected, preferably releasably, to the carrier 13, and the bearing portion 17 is hingedly connected via a hinge mechanism 16 to a fitting portion 15 to be fixed to the furniture part 3*b*. The bearing portion 17, the hinge mechanism and the fitting portion 15 jointly form the constructional unit of the connecting portion 14 configured to be connected to the carrier 13 of the chassis 12.

Figure 3:
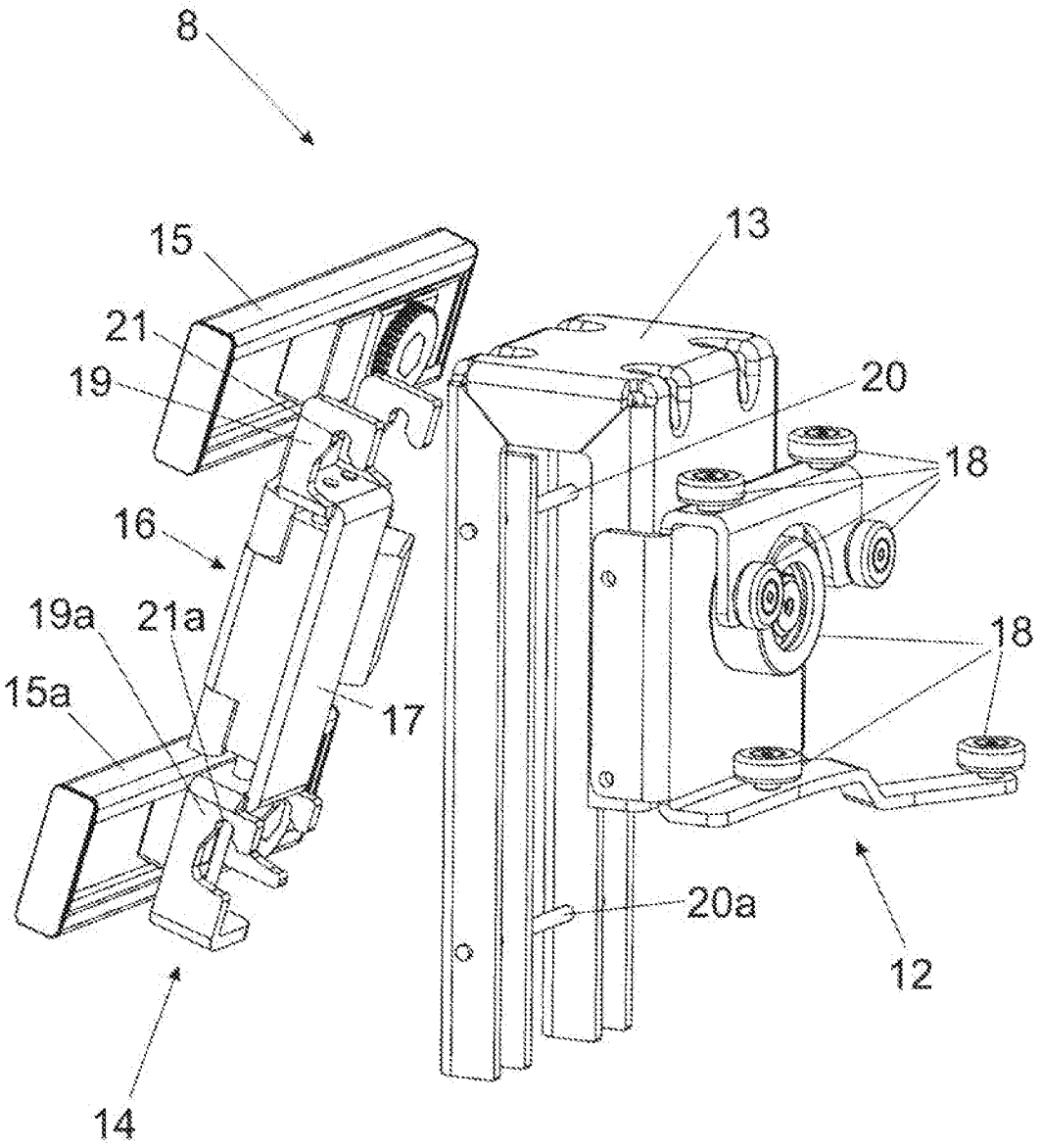
FIG. 3 shows the guide carriage with the chassis, and the connecting portion configured to be mounted to the chassis in a perspective view.

FIG. 3 shows the guide carriage 8 which includes the chassis 12, the carrier 13 and the connecting portion 14 to be fixed to the carrier 13. The chassis 12 includes at least one, preferably a plurality of, running wheel(s) 18, and two or more running wheels 18 having a vertical rotational axis and/or two or more running wheels 18 having a horizontal rotational axis may be provided. The connecting portion 14 is configured to be pre-mounted to the furniture part 3*b*, and the pre-mounted connecting portion 14 can be connected to the carrier 13 by at least one fastening device 19. The fastening device 19 can have at least one bearing location 20 arranged on the carrier 13, and the bearing location 20 engages into a corresponding recess 21 of the connecting portion 14 in a mounting position. The at least one bearing location 20, in the mounting position, is arranged substantially at a same height than the chassis 12, whereby a low lateral tilting moment is introduced in the chassis 12. In the shown embodiment, two fastening devices 19, 19*a* are provided, the two fastening devices 19, 19*a* being vertically spaced from one another and by which the connecting portion 14 can be releasably connected to the carrier 13. For this purpose, the carrier 13 includes at least two bearing locations 20, 20*a* spaced from each other in a height direction, and each of the two bearing locations 20, 20*a* engage into recesses 21, 21*a* spaced from each other in a height direction. Accordingly, the bearing portion 17 pre-mounted to the furniture part 3*b* can be engaged with the two recesses 21, 21*a* into the two bearing locations 20, 20*a* of the carrier 13, whereby a very simple mounting (by engaging) and demounting (by lifting) of the connecting portion 14 relative to the carrier 13 can be brought about. The connecting portion 14, in the shown embodiment, includes a bearing portion 17 (which is to be fixed via the recesses 21, 21*a* to the bearing locations 20, 20*a* of the carrier 13), two fitting portions 15, 15*a* which are spaced from each other in a height direction and which are to be fixed to the furniture part 3*b*, and a hinge mechanism 16 for pivotally connecting the fitting portions 15, 15*a* relative to the bearing portion 17 about an axis which preferably extends vertically in the mounting position.

Figure 4:
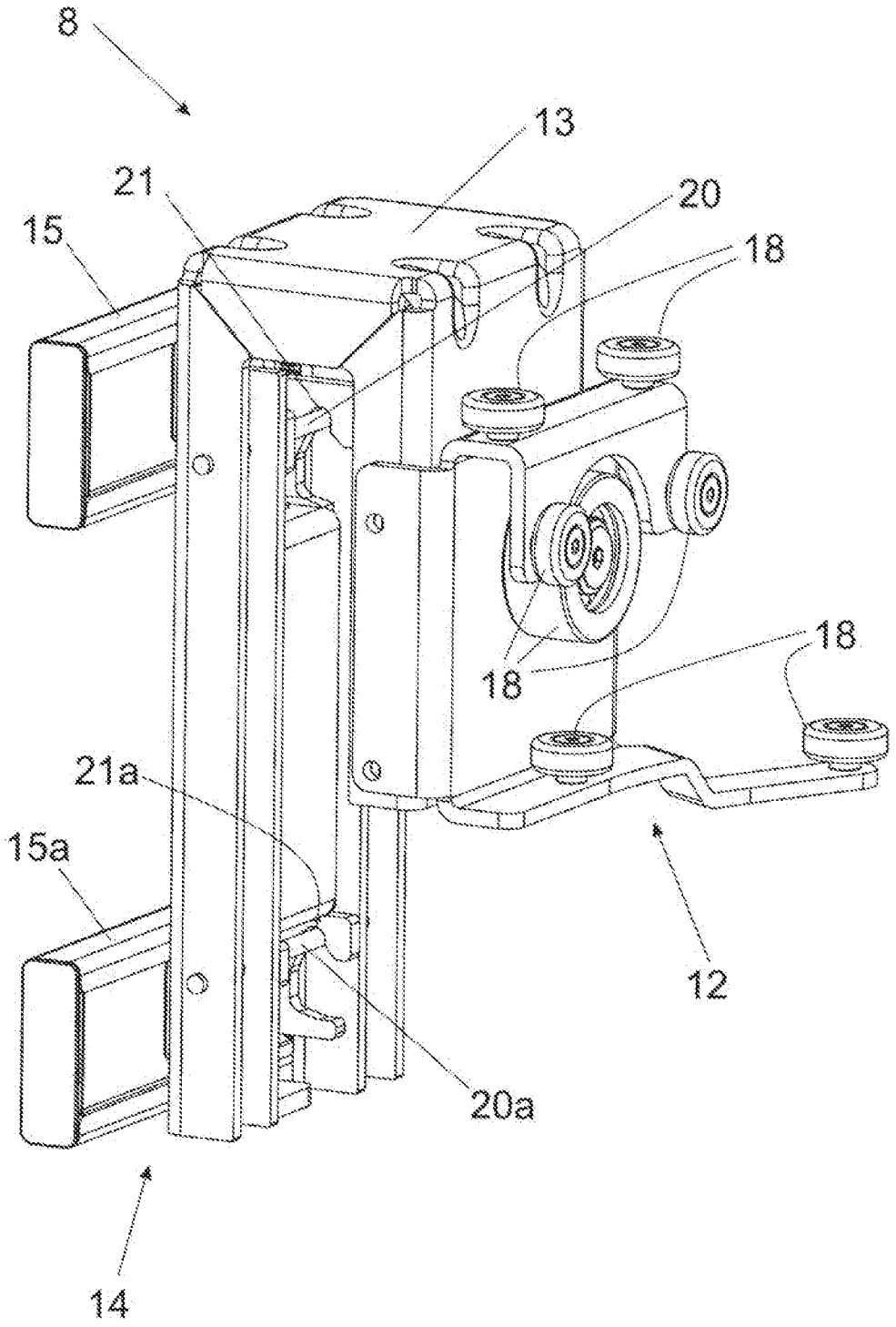
FIG. 4 shows the guide carriage in a perspective view from the rear.

FIG. 4 shows the guide carriage 8, and the connecting portion 14 is connected to the bearing locations 20, 20*a* of the carrier 13 via the recesses 21, 21*a*. By lifting the connecting portion 14 in relation to the carrier 13, a very simple demounting can be brought about, without additional securing means need to be released.

Figure 5:
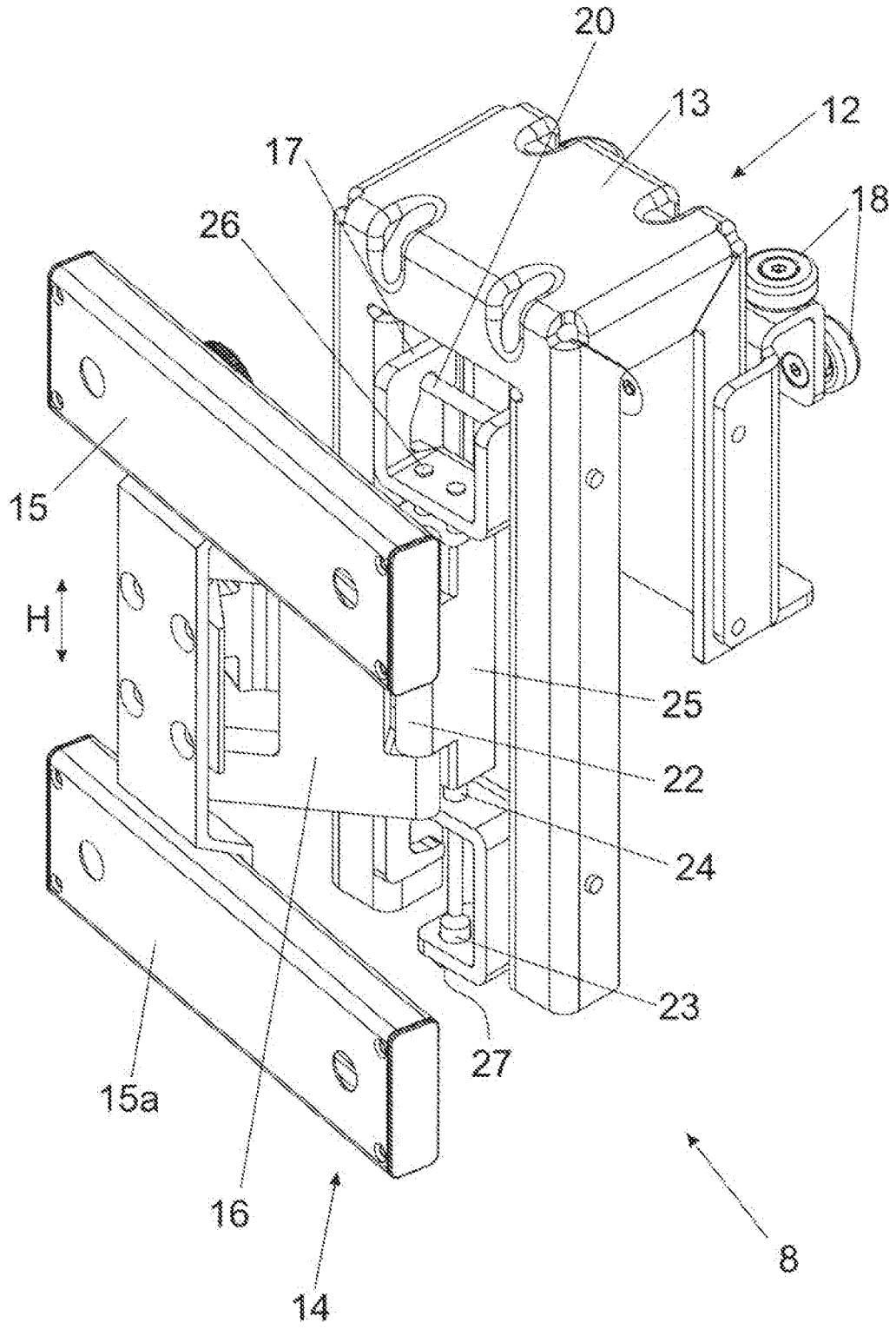
FIG. 5 shows the guide carriage in a perspective view from the front.

FIG. 5 shows the guide carriage 8 in a perspective view, in which the connecting portion 14 with the fitting portions 15, 15*a* to be fixed to the furniture part 3*b* is mounted to the carrier 13. By a positioning device 23, the fitting portions 15, 15*a* of the connecting portion 14 can be positioned relative to the chassis 12 in at least one linear direction, in the present case in a height direction (H). In the shown figure, the positioning device 23 includes a threaded portion 24 which is in a threading engagement with a bearing block 25. The threaded section 24 is arranged so as to be rotatable on the bearing portion 17, however, undisplaceable in the axial direction. By an actuation of an actuating element 27 (for example with a tool receiving device), the threaded section 24 can be rotated, and the bearing block 25 (and therewith the fitting portions 15, 15*a*) can be adjusted in the height direction (H). For linearly guiding the bearing block 25, a guiding rod 26 is provided. The guiding rod 26 extends parallel to the threaded section 24, and the bearing block 25 can be freely displaced along the guiding rod 26 upon a rotational movement of the threaded section 24. By the positioning device 23, the furniture part 3*b* can be adjusted in the height direction (H) relative to the other furniture part 3*a* in the mounted condition.

Figure 6A:
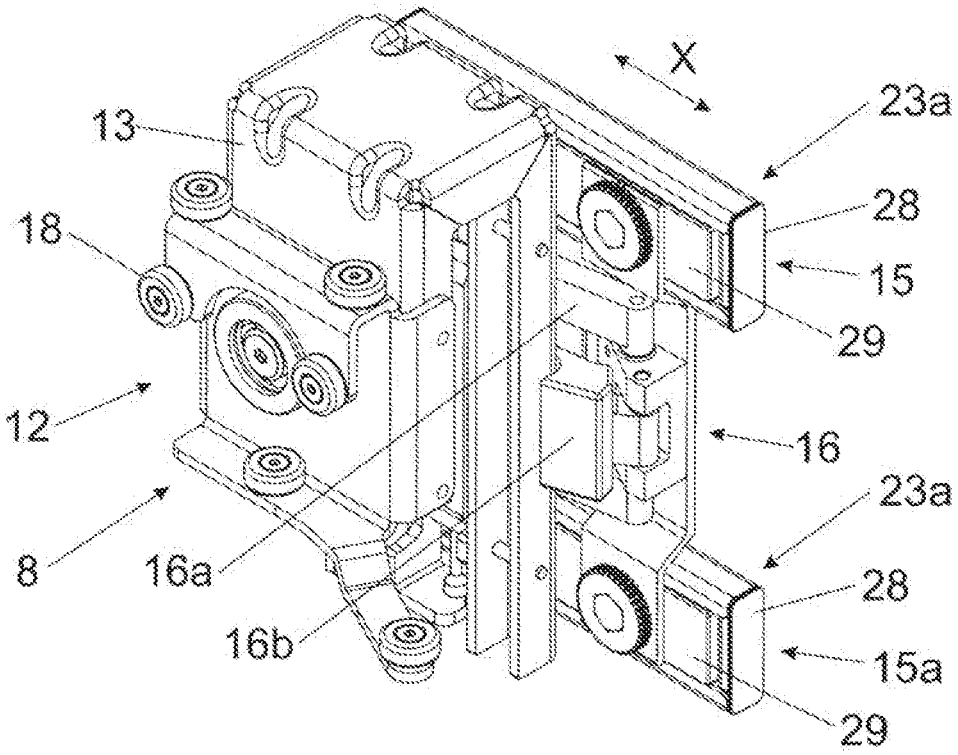
FIG. 6*a*, 6*b* show the guide carriage in two different positions of the fitting portions in a lateral direction.

FIG. 6*a* shows the guide carriage 8 in a perspective view from the rear, in which further positioning devices 23*a* are provided by which the furniture part 3*b* to be connected to the fitting portions 15, 15*a* can be positioned in a lateral direction (X) in a relation to the other furniture part 3*a*. Each of the fitting portions 15*a*, 15*a* includes a sliding portion 28, and each of the sliding portions 28 are linearly displaceably supported in the lateral direction (X) relative to base portions 29. Each of the sliding portions 28 and the base portions 29 are frictionally connected to one another, and the sliding portions 28 are configured to be displaced relative to the base portions 29 by applying a force against a frictional resistance. Visible is also the hinge mechanism 16 for the pivotable support of the two fitting portions 15, 15*a*, and the hinge mechanism 16 includes at least two pivotable hinge levers 16*a*, 16*b*.

Figure 6B:
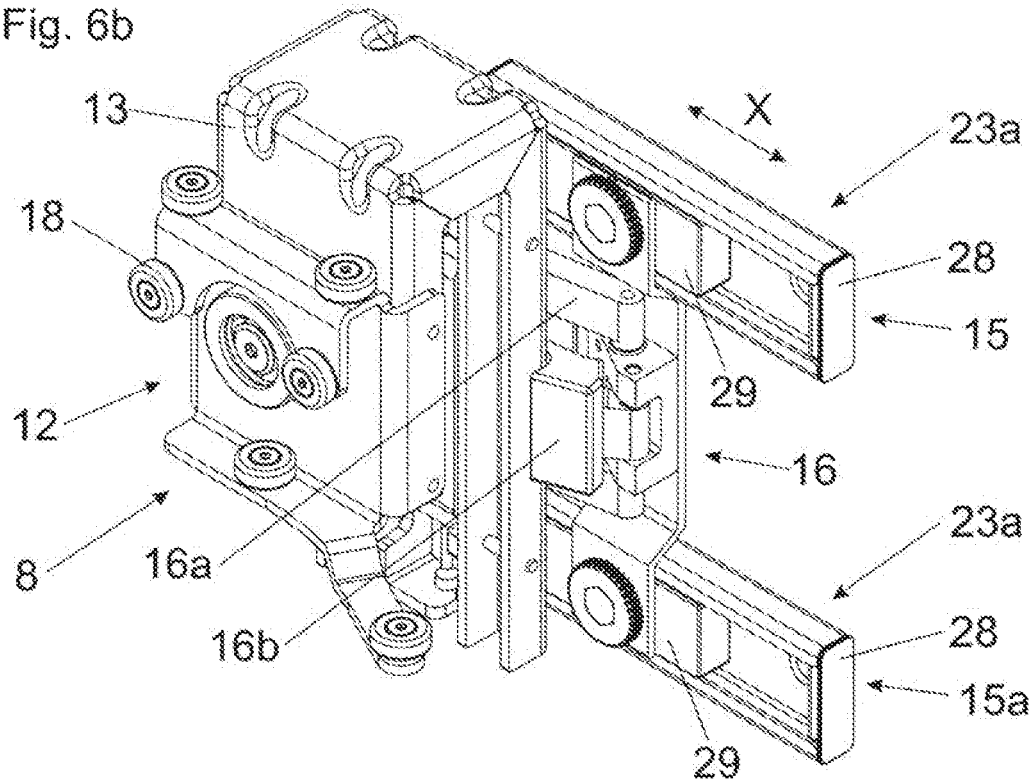

FIG. 6*b* shows the guide carriage 8 in which the sliding portions 28 have been displaced relative to the base portions 29 by applying a force to the furniture part 3*b* in a lateral direction (X). This clearly emerges from a direct comparison of FIG. 6*a* with FIG. 6*b*.

Figure 7:
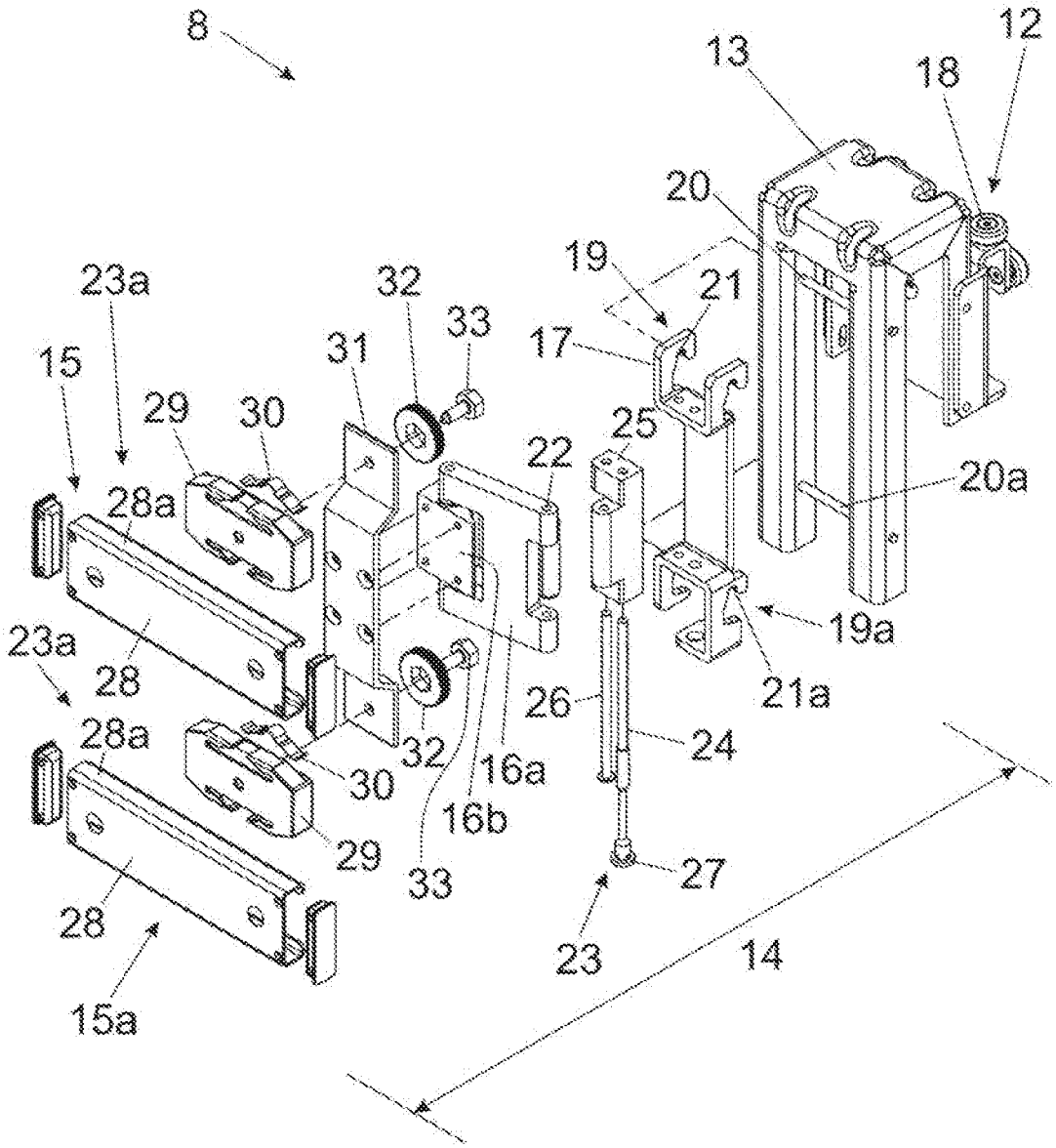
FIG. 7 shows the guide carriage in an exploded view.

FIG. 7 shows the guide carriage 8 in an exploded view. Arranged or formed on the carrier 13 is the chassis 12 having at least one running wheel 18. The bearing portion 17 of the connecting portion 14 is configured to be fixed via the fastening devices 19, 19*a* having the recesses 21, 21*a* to the bearing locations 20, 20*a* of the carrier 13. The bearing block 25 is movably mounted on the bearing portion 17, and the bearing portion 25 is displaceable in the height direction (H) relative to the bearing portion 17 upon pivoting the actuating element 27, and the bearing block 25 is guided along the guide rod 26. The two hinge levers 16*a*, 16*b* of the hinge mechanism 16 are pivotally connected to the bearing block 25, and the hinge lever 16*b* is configured to be connected to a holding device 31. The two base portions 29 of the fitting portions 15, 15*a* are fixed to the holding device 31 via supporting discs 32 and by screws 33. Each of the sliding portions 28 of the fitting portions 15, 15*a* is frictionally connected to the base portions 29. In the shown embodiment, the frictional connection between the base portions 29 and the sliding portions 28 is effected by spring elements 30. Each of the spring elements 30 are configured as prestressed leaf springs which produce the frictional force between the base portions 29 and the sliding portions 29. The spring elements 30 are thereby operative between an upper side of the base portions 29 and an angled limb 28*a* of the sliding portions 28.

The invention claimed is:

1. A guide carriage for the displaceable support of a furniture part on a guide rail, wherein the guide carriage includes:

a chassis having at least one pivotally mounted running wheel; and a connecting portion for connecting the guide carriage to the furniture part; and a positioning device for positioning the connecting portion relative to the chassis in at least one linear direction, wherein the chassis is connected to a carrier, and the connecting portion is configured to be releasably connected to the carrier by a fastening device, and wherein the fastening device includes a bearing location arranged on the carrier, and the bearing location engages in a recess of the connecting portion in a mounting position of the connecting portion.

2. The guide carriage according to claim 1, wherein the positioning device is configured so as to be separate from the fastening device and is arranged on the connecting portion.

3. The guide carriage according to claim 1, wherein the positioning device is a first positioning device and the guide carriage further comprises a second positioning device, wherein the connecting portion can be adjusted in relation to the chassis in a height direction by the first positioning device and can be adjusted in relation to the chassis in a lateral direction by the second positioning device, and wherein the first positioning device and the second positioning device are arranged on the connecting portion.

4. The guide carriage according to claim 1, wherein the positioning device is configured as a compensation device for passively compensating a position of the connecting portion in relation to the chassis, wherein a self-locking connection between the connecting portion and the chassis is provided, and wherein the connecting portion can be adjusted relative to the chassis by applying a force against the self-locking connection.

5. The guide carriage according to claim 1, wherein the bearing location, in the mounting position, is arranged substantially at a same height as the chassis.

6. The guide carriage according to claim 1, wherein the bearing location is one of at least two bearing locations arranged on the carrier, the at least two bearing locations being spaced from each other in a height direction, and wherein the at least two bearing locations engage in recesses of the connecting portion, respectively, the recesses being spaced from each other in the height direction.

7. The guide carriage according to claim 6, wherein the connecting portion can be connected to the carrier by engaging the at least two bearing locations in the recesses, respectively.

8. The guide carriage according to claim 1, wherein the positioning device includes a movably-mounted actuating element, and wherein the connecting portion can be adjusted relative to the chassis in a height direction and/or in a lateral direction by an actuation of the actuation element.

9. The guide carriage according to claim 8, wherein the actuating element is rotatably mounted, and wherein a threaded section of the positioning device can be rotated by a rotation of the actuating element.

10. The guide carriage according to claim 1, wherein the connecting portion includes a bearing portion to be fixed to the carrier via the bearing location, and a fitting portion to be fixed to the furniture part, wherein the bearing portion and the fitting portion are pivotally connected to one another about an axis by a hinge mechanism.

11. The guide carriage according to claim 10, wherein the hinge mechanism includes at least two pivotable hinge levers.

12. The guide carriage according to claim 10, wherein the fitting portion includes a base portion and a sliding portion to be fixed to the furniture part, and wherein the sliding portion is displaceably supported relative to the base portion so that the sliding portion can be positioned in a height direction and/or in a lateral direction relative to the base portion.

13. The guide carriage according to claim 12, wherein the sliding portion and the base portion are frictionally connected to one another, and wherein the sliding portion can be displaced relative to the base portion by applying a force against a frictional force.

14. The guide carriage according to claim 13, wherein the sliding portion and the base portion are frictionally connected to one another by at least one spring element.

15. The guide carriage according to claim 12, wherein the sliding portion is one of at least two sliding portions spaced from each other in the height direction, wherein the base portion is one of at least two base portions spaced from each other in the height direction, the at least two sliding portions being configured so as to be displaceable relative to the at least two base portions, respectively.

16. An arrangement comprising a guide rail and the guide carriage according to claim 1, wherein the guide carriage is displaceably supported relative to the guide rail.

17. A method for mounting the guide carriage according to claim 1 to a guide rail, the method comprising:

mounting the chassis to the guide rail, independently and separately from the connecting portion;

mounting the connecting portion to the furniture part, independently and separately from the chassis;

connecting the furniture part via the fastening device to the chassis mounted to the guide rail, via the connecting portion mounted to the furniture part; and in a connected condition between the connecting portion and the chassis, adjusting a position of the connecting portion relative to the chassis by the positioning device.

18. The guide carriage according to claim 1, wherein the carrier is U-shaped.

19. The guide carriage according to claim 10, wherein the axis extends vertically in the mounting position.

20. A guide carriage for the displaceable support of a furniture part on a guide rail, wherein the guide carriage includes:

a chassis having at least one pivotally mounted running wheel;

a connecting portion for connecting the guide carriage to the furniture part; and a positioning device for positioning the connecting portion relative to the chassis in at least one linear direction, wherein the chassis is connected to a carrier, and the connecting portion is configured to be releasably connected to the carrier by a fastening device, wherein the connecting portion includes a bearing portion to be fixed to the carrier and a fitting portion to be fixed to the furniture part, wherein the bearing portion and the fitting portion are pivotally connected to one another about an axis by a hinge mechanism, and wherein the hinge mechanism includes at least two pivotable hinge levers.

21. A guide carriage for the displaceable support of a furniture part on a guide rail, wherein the guide carriage includes:

a chassis having at least one pivotally mounted running wheel;

a connecting portion for connecting the guide carriage to the furniture part; and a positioning device for positioning the connecting portion relative to the chassis in at least one linear direction, wherein the chassis is connected to a carrier, and the connecting portion is configured to be releasably connected to the carrier by a fastening device, wherein the positioning device is configured so as to be separate from the fastening device and is arranged on the connecting portion, wherein the connecting portion includes a bearing portion to be fixed to the carrier and a fitting portion to be fixed to the furniture part, and wherein the bearing portion and the fitting portion are pivotally connected to one another about an axis by a hinge mechanism.

* * * * *